US007406004B1

(12) United States Patent
Hiromori

(10) Patent No.: US 7,406,004 B1
(45) Date of Patent: Jul. 29, 2008

(54) CLOCK WITH AN INSERTION PART

(75) Inventor: Junji Hiromori, Tokyo (JP)

(73) Assignee: Hiromori Corporation, Tokyo (JP)

( * ) Notice: Subject to any disclaimer, the term of this patent is extended or adjusted under 35 U.S.C. 154(b) by 517 days.

(21) Appl. No.: 11/093,558

(22) Filed: Mar. 30, 2005

(51) Int. Cl.
*G04B 37/00* (2006.01)
*G04B 19/04* (2006.01)

(52) U.S. Cl. ..... 368/88; 368/228; 368/276; 368/309

(58) Field of Classification Search ..... 368/76, 368/80, 88, 223, 228, 276, 278, 285, 309
See application file for complete search history.

(56) References Cited

U.S. PATENT DOCUMENTS

| | | | | |
|---|---|---|---|---|
| 2,044,314 | A | 6/1936 | Mattman | |
| 2,107,383 | A | 2/1938 | Mattman | |
| 2,998,664 | A * | 9/1961 | McIntire | 40/473 |
| 3,090,193 | A | 5/1963 | Jensen | |
| D203,941 | S | 3/1966 | Jaffe | |
| 3,638,418 | A * | 2/1972 | Spadini | 368/74 |
| 3,713,286 | A * | 1/1973 | Trame | 368/276 |
| 3,992,872 | A * | 11/1976 | Stanish | 368/67 |
| 4,491,425 | A | 1/1985 | Young-koo | |
| 4,525,077 | A * | 6/1985 | Ketner | 368/77 |
| 5,159,583 | A * | 10/1992 | Lee | 368/223 |
| 6,290,387 | B1 | 9/2001 | Chen | |
| 6,595,683 | B1 | 7/2003 | Cetera | |
| 6,804,170 | B1 | 10/2004 | Chan | |
| 7,052,798 | B2 * | 5/2006 | Kaelin et al. | 429/96 |
| 2004/0257916 | A1 | 12/2004 | Yamazaki | |
| 2005/0180268 | A1 | 8/2005 | Yamazaki | |

* cited by examiner

*Primary Examiner*—Vit W Miska
(74) *Attorney, Agent, or Firm*—Dilworth & Barrese, LLP.

(57) ABSTRACT

A clock with an insertion part is provided to facilitate presenting various illustrations such as photographs, advertising copy, logos, etc., upon the front surface thereof after purchase by a customer. The insertion part is separately provided apart from the clock and then inserted into and coupled to the main clock frame from the rear after assembly of the clock. In a preferred embodiment, the clock includes the main body frame, an hour plate, a transparent case and a backside case, with the part being inserted into the insertion opening provided in the backside case.

14 Claims, 2 Drawing Sheets

CLOCK WITH AN INSERTION PART

BACKGROUND OF THE INVENTION

1. Field of the Invention

The present invention generally relates to a clock, and more particularly to a clock having a part with names or logos which can be inserted into a main body frame of the clock after molding and assembly and be securely coupled thereto.

2. Description of the Related Art

In general, visual features such as logos or characters have been printed upon faces or hour plates of conventional clocks before assembly, at the clock factory itself. This has undesirably increased cost per unit manufacture because of expenditures for providing printing blocks and the actual steps of printing upon the clock faces. Costs especially increase when only a small shipment of specialty clocks with unique clock faces are ordered. Additionally, the entire clock had to be assembled right at the clock factory, adding to increased expense in manufacturing and shipping where delicate protruding parts, such as a base frame, could break unless especially packed during shipping.

It is desirable to allow a purchaser of a clock to place their own visual display, e.g., a decal, upon the face of a clock. This has not been possible once components of a clock had been assembled together, necessitating cumbersome disassembly.

U.S. application Ser. No. 11/021,122 filed Dec. 23, 2004, discloses, among other features, providing a display surface for an image such as an advertising logo and by sliding a base from a lower direction into mating with a main body of the clock. This allows the main body and base to be separately packaged and shipped prior to assembly.

However, there is also a need to manufacture and ship a completely assembled clock to a purchaser such as a wholesaler or retailer, and who then wants to affix a personal or advertising logo to a front the clock face. However, this is not readily feasible if the clock has already been assembled at the factory prior to shipping.

Accordingly, it is an object of the present invention to enhance display of time.

It is also an object of the present invention, to improve assembly and shipping of a timepiece such as a clock with appropriate indicia thereon.

It is an additional object of the present invention to improve visual display upon a time piece such as a clock.

It is a further object of the present invention to improve coupling of components forming a timepiece such as a clock together to improve visual display of time and accompanying indicia.

It is another object of the present invention to improve versatility in display of time by improving ease with which a unique visual display can be provided upon the face of a timepiece.

It is yet another object of the present invention to reduce expenditures of manufacturing a clock, especially where the clock is required for different, special uses.

SUMMARY OF THE INVENTION

These and other objects are attained by the present invention which is directed to a clock with an insertion part which is separately manufactured, e.g., molded, apart from the main body frame of the clock and then coupled to the clock in secure fashion. The insertion part can be provided with a visual illustration, e.g., by a purchaser such as a consumer, importer, wholesaler, and then coupled to the main body frame such that the visual illustration is easily displayed upon the front clock face being flush with a top face of the insertion part. There is no danger of the clock main body frame and insertion part becoming detached from one another once the two components are securely coupled together.

Generally, in a factory, after the clock main body and the hour plate are combined, the backside case and a transparent case at a front side may be attached and secured by screws. The insertion part, prepared in advance on which individual indicia/images such as names of clients and/or designated logos have been printed separately, can be easily inserted into an opening from a back of the main body frame after shipping or distribution.

Conventional clocks are provided with logos where an insertion base with logos is inserted between a clock main body and a transparent cover. However, with the present invention, the printing on the insertion part can be accomplished with lower cost than printing logos and the like on the clock face or clock body itself.

Names are usually printed on hour plates while clocks are being manufactured in clock factories. However, such manufacturing becomes difficult when ordered in a small lot or in short delivery times. To the contrary, the clock of the present invention has a structure whereby distributors in the market can separately provide information for display just before or even after shipping of the assembled clock. Instead of printing on the clock face during manufacturing, the present invention can display information as effectively as when printing is performed in the factory. The products of the present invention are mainly available for advertisement or giftware of enterprises.

With the present invention, the main body frame and insertion part can be separately packaged and shipped, reducing cost of assembly. Unique visual indicia can be placed by a customer upon each clock face, reducing cost per unit especially where the same type of clock is required for different uses. Need to provide printing and accompanying printing blocks at the manufacturing site has been eliminated.

In a preferred embodiment, the insertion part includes a hollow body with a bottom having a surface portion, a side portion, and a leg portion which are integrally formed. Additionally, the part includes a spring body made of elastic material at the side portion, which closely contacts an abutting portion of the main body frame upon insertion, to secure the part to the clock frame for display.

BRIEF DESCRIPTION OF THE DRAWINGS

The present invention will be described in greater detail with reference to the accompanying drawings in which.

DESCRIPTION OF THE PREFERRED EMBODIMENTS

The characteristics of the present invention include a clock or a wall clock into which a part with names or logos can be inserted to easily display information, e.g., for advertising.

Figure 1:
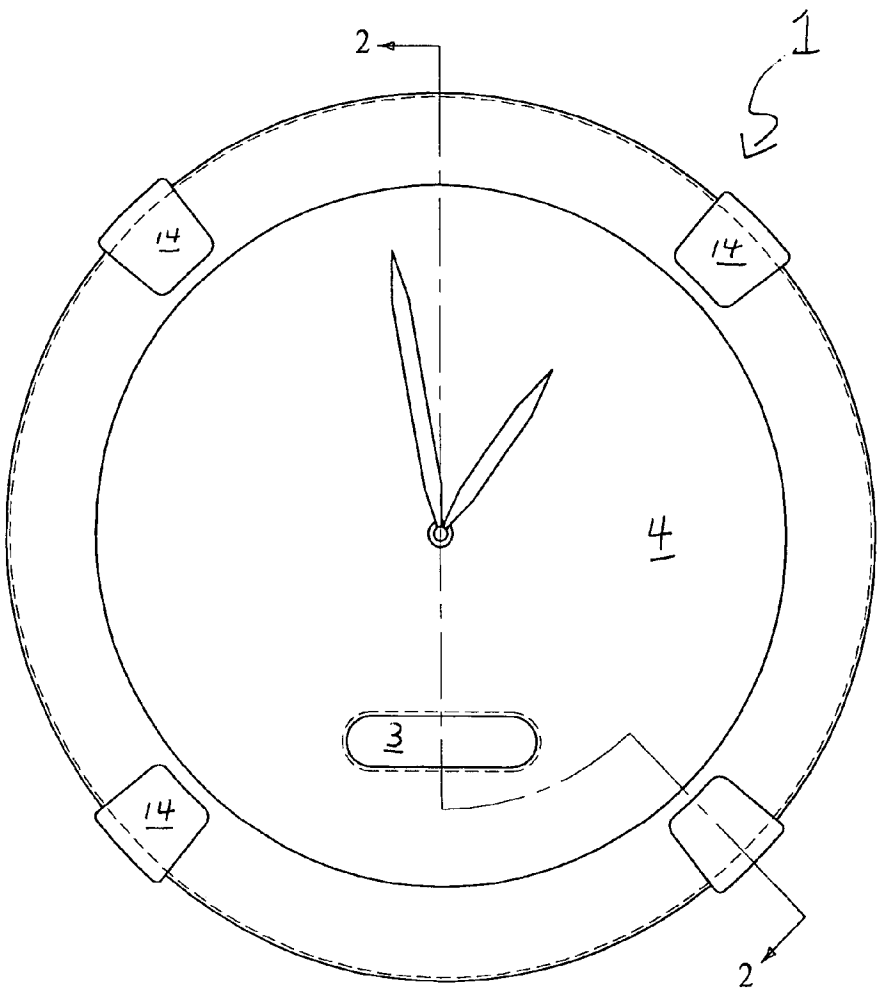
FIG. 1 illustrates a front elevational view of the clock with an insertion part according to the present invention in assembled condition.

Referring to the drawings, the clock 1 with an insertion part 3 already positioned thereon is illustrated in the front view of FIG. 1 as including a main body 2 and separate insertion part 3, in addition to an hour plate 4, a transparent plastic or glass front cover 6 and a backside case 5. The part 3 can be easily inserted into an insertion opening provided in the backside case 5, i.e., inserted from the rear or back of the clock 1. As best seen in the sectional view of FIG. 2, the insertion part 3 used in the present invention is structured and arranged such that a surface of the part 3 on which indicia, names and/or logos can be displayed, appears visible upon the hour plate 4 after insertion. Indicia such as an advertising logo is provided upon this front surface. The insertion part 3 is prevented from passing forwardly beyond the front of the hour plate 4 when a leg portion provided at a tip of a side of the part 3 comes into contact with a rear surface of the backside case 5. Then, a spring body 11 as shown, e.g., in FIG. 3, and provided at an end of the insertion part 3, elastically expands outwardly to thereby fix the part 3 in place.

Figure 3:
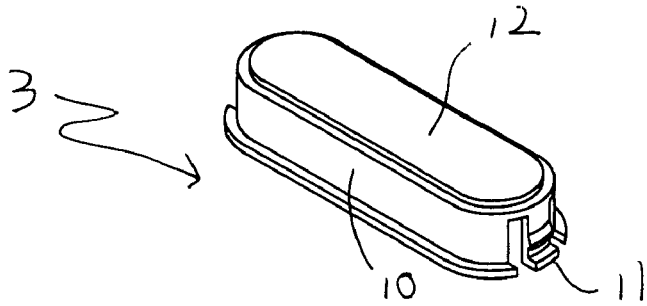
FIG. 3 illustrates a perspective view of the insertion part prior to assembly in FIG. 1.

The insertion part 3 is initially provided apart from the main frame body 2 as illustrated in FIG. 3. In the illustrated embodiment, the insertion part 3 is provided with a hollow body with a bottom and having a front surface portion 12, a side portion 10, and the leg portion or collar which are all integrally formed. In this regard, the part 3 is provided with a spring body 11 at a side thereof, and which closely contacts abutting portions of the backside case 5 when inserted.

In assembling, the front or top surface 12 of the part 3 can first be provided with a visual display, e.g. a decal, logo, advertising copy, picture, photograph, etc. After the appropriate visual display has adhered to the front or top surface 12 of the part 3, then the part 3 is simply inserted into insertion opening provided in the backside case 5 from the rear of the clock 1.

The clock and insert part of the present invention can be manufactured from any appropriate material, e.g. hard plastic, such as by appropriate molding. More particularly, the spring body 11 of the insertion part 3 can be made of elastic material at a portion of the side thereof. The clock body 1 has been illustrated with substantially circular shape in FIG. 1. but may also have a substantially tetragonal, quadrilateral shape or triangular shape. Furthermore, the front surface 12 of the insertion part 3 itself, may take any of a variety of shapes, e.g., elliptic, rectangular, or quadrilateral, and names and/or logos are be printed on the surface of the insertion part 3, with the clock face 4 itself being appropriately complementarily-shaped to ensure proper mating of adjacent surfaces upon engagement as illustrated. Particularly, in case of a circular clock as shown in FIG. 1, the shape of the insertion part 3 is preferably oblong with an elliptic tip, for example, with a width of 17 mm, a length of 55 mm and a height of 12 mm. Additionally, in the case of a quadrilateral clock, the shape of the insertion part 3 is preferably angular such as rectangular or quadrilateral. The selected color of the part 3 is preferably painted on the surface 12 so that the names and/or logos can be displayed thereon with high definition and visibility.

Figure 2:
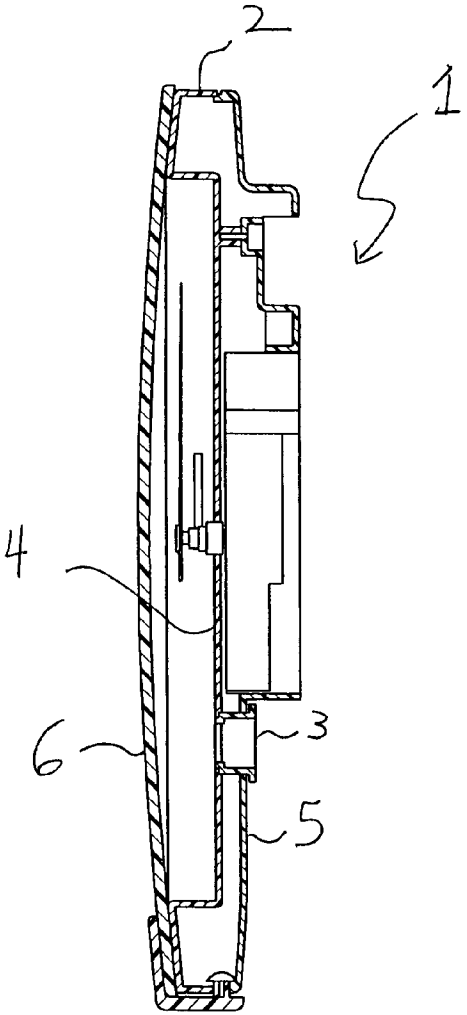
FIG. 2 illustrates a sectional view along line 2-2 of FIG. 1.
Figure 4:
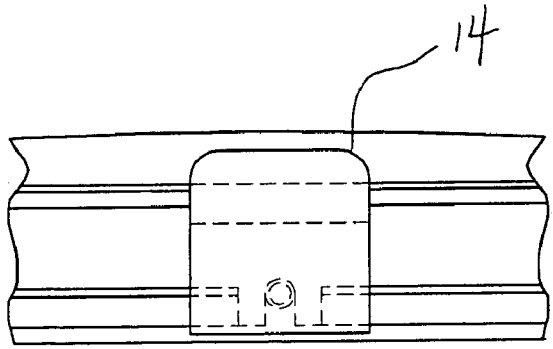
FIG. 4 illustrates a plan view of the one of the clips holding the clock together.
Figure 5:
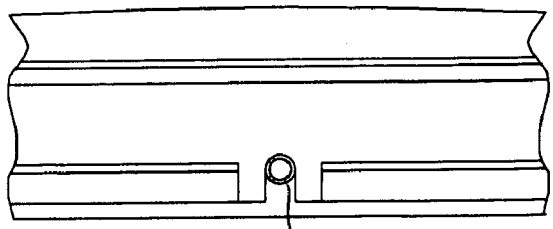
FIG. 5 illustrates a plan view, similar to FIG. 4, with the extending flange of the clip omitted.
Figure 6:
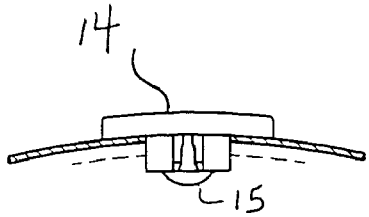
FIG. 6 illustrates a rear view of the clip shown in FIG. 4.

In assembly, the main body 2 of the clock 1 and hour plate 4 are first combined, with the backside case 5 and front cover 6 then being secured together by the clips 14 and screws 15 as shown in FIGS. 3-5. The insertion part 3 can then be simply slid into the respective opening from the rear of the clock 1, as best seen in FIG. 2. Thus the clock 1 according to the present invention can be assembled in its entirety prior to shipping to a customer. The customer can then simply insert personalized display indicia found upon a discrete insertion part 3, without disturbing either the assembled clock 1 or operation thereof.

The preceding description of the present invention is merely exemplary and is not intended to limit the scope thereof in any way.

What is claimed is:

1. A clock with an insertion part, comprising a main body frame of the clock structured and arranged to support a clock face and contain a clockwork mechanism for showing current time upon the clock face, said main body frame comprising an insertion opening extending from a back surface through a front surface thereof on the lock face, an insertion part separately provided apart from said main body and structured and arranged to be inserted into said insertion opening from the back direction of the main body frame and securely seat in said opening in exposed position upon said clock face, and means for both receiving said insertion part in said opening from the back direction and securing said insertion part in said exposed position against being pushed entirely through said front surface on the clock face.

2. The clock according to claim 1, wherein said opening and insertion part are structured and arranged to complementarily mate with one another.

3. The clock according to claim 1, wherein a front surface of said insertion part is substantially elliptical, rectangular, or quadrilateral.

4. The clock according to claim 2, wherein a front surface of said insertion part is substantially elliptical, rectangular, or quadrilateral.

5. The clock according to claim 4, wherein said surface comprises images such as names and/or logos situated thereon.

6. The clock according to claim 3, wherein said surface comprises images such as names and/or logos situated thereon.

7. The clock according to claim 1, wherein said surface comprises images such as names and/or logos situated thereon.

8. The clock according to claim 1, wherein said insertion part is constituted by a hollow body having a bottom, a display surface portion structured and arranged to face the front of the clock upon insertion, a side portion, and a leg portion which are integrally formed therewith.

9. The clock according to claim 8, wherein said means comprise an elastic mechanism upon said leg portion structured and arranged to expand outwardly upon insertion into said opening, contact a back surface of the main body frame and fix said insertion part in said opening.

10. The clock according to claim 1, wherein said means comprise an elastic mechanism, said elastic mechanism at a side portion, structured and arranged to expand outwardly upon contacting a back surface of the main body frame and fix said insertion part in said opening.

11. The clock according to claim 9, wherein said elastic mechanism is provided on opposite ends of said insertion part.

12. The clock according to claim 1, wherein a top face of said insertion part is flush with the clock face upon securing upon said main body frame.

13. The clock according to claim 9, wherein a top face of said insertion part is flush with the clock face upon securing upon said main body frame.

14. The clock according to claim 10, wherein a top face of said insertion part is flush with the clock face upon securing upon said main body frame.

* * * * *